US010501933B2

(12) United States Patent
Stroyer et al.

(10) Patent No.: US 10,501,933 B2
(45) Date of Patent: Dec. 10, 2019

(54) WEATHER RESISTANT TEMPORARY WALL SYSTEM AND METHOD

(71) Applicant: Duraframe, LLC, Webster, NY (US)

(72) Inventors: Kurt Stroyer, Rochester, NY (US); Glenn Stroyer, Webster, NY (US); Douglas Congdon, Pittsford, NY (US)

(73) Assignee: Duraframe, LLC, Webster, NY (US)

( * ) Notice: Subject to any disclaimer, the term of this patent is extended or adjusted under 35 U.S.C. 154(b) by 0 days.

(21) Appl. No.: 15/991,461

(22) Filed: May 29, 2018

(65) Prior Publication Data

US 2018/0340331 A1 Nov. 29, 2018

Related U.S. Application Data

(60) Provisional application No. 62/511,722, filed on May 26, 2017.

(51) Int. Cl.

| | |
|---|---|
| ***E04B 2/74*** | (2006.01) |
| ***E04B 2/78*** | (2006.01) |
| ***E04G 21/24*** | (2006.01) |
| *E04G 21/26* | (2006.01) |
| *E04G 21/28* | (2006.01) |
| *E04B 2/82* | (2006.01) |

(52) U.S. Cl.

CPC ..... *E04B 2/7453* (2013.01); *E04B 2/7836* (2013.01); *E04G 21/242* (2013.01); *E04B 2/82* (2013.01); *E04B 2002/7461* (2013.01); *E04G 21/26* (2013.01); *E04G 21/28* (2013.01)

(58) Field of Classification Search

CPC ..... E04B 2/7453; E04B 2/7836; E04B 2/82; E04B 2002/7461; E04G 21/242; E04G 21/26; E04G 21/28

See application file for complete search history.

(56) References Cited

U.S. PATENT DOCUMENTS

| | | | | |
|---|---|---|---|---|
| 2,394,443 A * | 2/1946 | Guignon, Jr. | ..... | E04B 1/617 52/580 |
| 2,441,364 A * | 5/1948 | Maynard | ..... | E04B 2/04 256/19 |
| 2,822,898 A * | 2/1958 | Richards | ..... | E04B 2/7448 52/471 |
| 2,891,638 A * | 6/1959 | Grundy | ..... | E04B 1/6175 52/578 |
| 3,203,145 A * | 8/1965 | Raynes | ..... | E04B 1/24 52/22 |

(Continued)

*Primary Examiner* — James M Ference

(74) *Attorney, Agent, or Firm* — Woods Oviatt Gilman LLP; Katherine H. McGuire, Esq.

(57) ABSTRACT

A weather resistant temporary wall system and method useful for forming a temporary barrier during building construction or renovation includes a series of modular wall panels that may be removably fit together in the size needed. The wall panels have complimentary shaped edge profiles that form a protective barrier against water penetration. The wall panels may be assembled on site in vertically stacked relationship between a pair of support posts which extend from floor to ceiling. The side edges of the wall panels have edge profiles that are complimentary in shape to the side edges of the support posts such that the panels may be removably attached to the support posts. The wall panels may further include a string reinforced polyethylene material for increased strength.

10 Claims, 7 Drawing Sheets

(56) References Cited

U.S. PATENT DOCUMENTS 3,312,032 A * 4/1967 Ames ..... E04B 2/78 52/580
3,350,828 A * 11/1967 Russell ..... E04B 1/6116 52/281
3,363,383 A * 1/1968 La Barge ..... E04B 1/6175 404/65
3,372,520 A * 3/1968 Hensel ..... B32B 3/12 52/394
3,378,977 A * 4/1968 Vervloet ..... E04B 2/74 52/481.2
3,397,496 A * 8/1968 Sohns ..... E04B 1/54 52/286
3,466,821 A * 9/1969 Cooper ..... E04B 2/80 52/204.1
3,557,509 A * 1/1971 Blaski ..... E04B 1/54 52/222
3,646,180 A * 2/1972 Winnick ..... B29C 44/12 264/45.3
3,667,180 A * 6/1972 Tischuk ..... E04F 13/0803 52/309.2
3,755,975 A * 9/1973 Herzer ..... E04B 1/14 52/86
3,777,430 A * 12/1973 Tischuk ..... E04C 2/292 52/309.9
3,789,567 A * 2/1974 Rae ..... E04B 1/68 52/584.1
3,995,402 A * 12/1976 Parenteau ..... E04B 2/7453 52/241
4,037,380 A * 7/1977 Pollock ..... E04B 2/7818 52/126.4
4,048,775 A * 9/1977 Dielman ..... E04H 1/1266 52/127.12
4,084,367 A * 4/1978 Saylor ..... B29D 24/005 428/113
4,123,885 A * 11/1978 Scott ..... E04F 13/0841 52/489.1
4,251,968 A * 2/1981 Raith ..... E04B 2/7401 52/471
4,304,083 A * 12/1981 Anderson ..... E04F 13/0878 52/309.9
4,550,543 A * 11/1985 Valenzano ..... E04C 2/34 264/46.5
4,682,457 A * 7/1987 Spencer ..... E04B 2/7425 52/220.7
4,742,653 A * 5/1988 Napier ..... E04B 1/3445 52/66
4,798,035 A * 1/1989 Mitchell ..... E04B 2/7409 52/242
4,852,317 A * 8/1989 Schiavello ..... E04B 2/7424 52/239
4,905,428 A * 3/1990 Sykes ..... E04B 2/7425 160/135
5,086,599 A * 2/1992 Meyerson ..... E04B 1/617 52/309.9
5,107,652 A * 4/1992 Sosa ..... E02D 29/025 160/135
5,125,201 A * 6/1992 Pieters ..... E04B 2/822 52/238.1
5,207,042 A * 5/1993 Molinar ..... E04B 1/0007 52/293.1
5,218,797 A * 6/1993 Kruse ..... E01F 8/0017 52/169.9
5,277,005 A * 1/1994 Hellwig ..... E04B 2/7422 174/495
5,305,567 A * 4/1994 Wittler ..... E04B 2/7425 160/135
5,344,700 A * 9/1994 McGath ..... E04B 1/12 428/304.4
5,361,556 A * 11/1994 Menchetti ..... E04B 2/7453 52/271
5,377,467 A * 1/1995 Barnavol ..... E04B 2/825 52/238.1
5,394,668 A * 3/1995 Lim ..... E04B 2/7416 52/239
5,396,750 A * 3/1995 Kleyn ..... E04C 2/20 52/792.11
5,444,955 A * 8/1995 Ou ..... E04B 2/7411 52/220.7
5,471,791 A * 12/1995 Keller ..... E04B 2/827 160/40
5,592,794 A * 1/1997 Tundaun ..... E04B 1/6162 52/220.7
5,644,877 A * 7/1997 Wood ..... E04B 2/7407 52/126.3
5,749,282 A * 5/1998 Brow ..... E04B 1/6813 52/209
5,784,843 A * 7/1998 Greer ..... A47B 83/001 52/220.7
5,787,665 A * 8/1998 Carlin ..... E04C 2/384 52/309.11
5,822,940 A * 10/1998 Carlin ..... E04B 2/7453 52/479
6,085,485 A * 7/2000 Murdock ..... E04B 7/20 52/309.11
6,105,322 A * 8/2000 Chang ..... E04B 2/7425 160/135
6,112,485 A * 9/2000 Beyer ..... E04B 2/7437 52/239
6,128,876 A * 10/2000 Nitschke ..... E04B 2/7425 52/239
6,134,852 A * 10/2000 Shipman ..... A47B 57/425 52/220.7
6,141,925 A * 11/2000 Halvorson, Jr. ..... E04B 2/7455 52/126.3
6,260,329 B1 * 7/2001 Mills ..... E04C 2/049 52/309.4
6,286,275 B1 * 9/2001 Edwards ..... E04B 2/7422 52/220.2
6,295,778 B1 * 10/2001 Burt ..... E04B 1/12 52/233
6,314,704 B1 * 11/2001 Bryant ..... E04B 1/12 52/271
6,345,478 B1 * 2/2002 Pang ..... E04B 2/7455 52/238.1
6,374,552 B1 * 4/2002 Price ..... E04B 1/34342 52/169.12
6,418,671 B1 * 7/2002 DeRuiter ..... E04B 2/7422 211/103
6,430,885 B1 * 8/2002 Ito ..... E04F 13/0812 52/235
6,446,398 B2 * 9/2002 Weir ..... E04H 17/168 160/135
6,502,357 B1 * 1/2003 Stuthman ..... E04B 2/7448 52/239
6,543,164 B1 * 4/2003 Sperl ..... G09F 15/0068 40/605
6,658,808 B1 * 12/2003 Doherty ..... E04B 1/12 52/579
6,688,056 B2 * 2/2004 Von Hoyningen Huene ..... E04B 2/745 52/238.1
6,834,468 B1 * 12/2004 Kroie ..... B32B 15/12 52/309.9
7,197,853 B1 * 4/2007 Little, Jr. ..... E04B 2/7457 52/238.1
7,238,106 B2 * 7/2007 Scott ..... F24D 5/04 454/306
8,015,766 B2 * 9/2011 Gosling ..... E04B 2/7455 52/239
8,341,903 B2 * 1/2013 Haab ..... E06B 3/5454 52/238.1
8,381,468 B2 * 2/2013 Koupal ..... E04B 1/6162 52/282.1
8,997,436 B2 * 4/2015 Spear ..... E04F 13/0894 52/239
9,238,911 B2 * 1/2016 Kerley ..... E05B 65/006
10,041,249 B1 * 8/2018 Hebert ..... E04B 2/827

(56) References Cited

U.S. PATENT DOCUMENTS

2001/0013209 A1* 8/2001 Waalkes ..... A47B 21/06 52/239
2002/0046520 A1* 4/2002 Gonzalez-Rivera ... B65D 85/30 52/239
2002/0088188 A1* 7/2002 Chang ..... F21V 33/0032 52/238.1
2002/0095890 A1* 7/2002 Brauning ..... A47B 21/00 52/239
2002/0157335 A1* 10/2002 Vos ..... E04B 2/821 52/238.1
2002/0189180 A1* 12/2002 King ..... E04B 2/7422 52/243
2003/0041540 A1* 3/2003 Gravel ..... E04B 2/7422 52/239
2003/0089057 A1* 5/2003 Wiechecki ..... E04B 2/7427 52/238.1
2003/0208973 A1* 11/2003 Corden ..... E04B 2/7453 52/241
2003/0221392 A1* 12/2003 Furman ..... E04B 2/827 52/769
2004/0006945 A1* 1/2004 Price ..... E04B 2/06 52/605
2004/0049992 A1* 3/2004 Seavy ..... E04B 2/7453 52/79.1
2004/0060245 A1* 4/2004 Loblick ..... E04B 1/12 52/79.5
2004/0111997 A1* 6/2004 Gigiakos ..... E04B 2/7453 52/579
2005/0108964 A1* 5/2005 Brinkkotter ..... B29C 48/0022 52/455
2006/0230700 A1* 10/2006 Chen ..... E04C 2/20 52/586.1
2007/0039262 A1* 2/2007 Forgy ..... E04C 2/296 52/309.16
2007/0039287 A1* 2/2007 Solomon ..... E04C 2/296 52/783.1
2007/0261353 A1* 11/2007 Cullen ..... E04F 13/04 52/590.2
2007/0277469 A1* 12/2007 Marker ..... E04B 2/7453 52/582.1
2007/0277476 A1* 12/2007 Macleod ..... E04B 2/58 52/787.1
2008/0209827 A1* 9/2008 Webb ..... E04B 2/821 52/220.7
2008/0245005 A1* 10/2008 Fennell ..... E04C 1/40 52/223.7
2009/0000240 A1* 1/2009 Smalley, III ..... E04B 1/14 52/741.13
2009/0133354 A1* 5/2009 Spear ..... E04B 2/7453 52/588.1
2010/0058700 A1* 3/2010 LeBlang ..... E04B 1/165 52/506.05
2010/0083601 A1* 4/2010 Glazik ..... E04B 2/7453 52/481.1
2010/0186326 A1* 7/2010 Cummings ..... E04B 2/7422 52/239
2011/0047908 A1* 3/2011 Brusman ..... E04C 2/205 52/220.1
2011/0099929 A1* 5/2011 Liegeois ..... E04B 2/7425 52/241
2011/0126487 A1* 6/2011 Browning ..... E04B 1/14 52/586.1
2011/0192555 A1* 8/2011 Frezouls ..... E04B 2/7433 160/378
2011/0258941 A1* 10/2011 Dalo ..... E04B 1/34315 52/11
2011/0258943 A1* 10/2011 De Zen ..... E04B 1/34321 52/43
2013/0025220 A1* 1/2013 Yu ..... E04C 2/52 52/220.7
2013/0067838 A1* 3/2013 Black ..... E04C 2/22 52/220.7
2013/0174505 A1* 7/2013 Semidey ..... E04C 2/292 52/309.1
2014/0090321 A1* 4/2014 Olszewski ..... B32B 3/06 52/309.4
2014/0311076 A1* 10/2014 Ishaque ..... E04F 13/0803 52/404.2
2015/0233114 A1* 8/2015 Hoefler ..... E04B 2/7433 52/239
2016/0153191 A1* 6/2016 Henderson ..... E04C 2/46 52/220.2
2016/0333580 A1* 11/2016 Vehniainen ..... E04G 21/24
2018/0340331 A1* 11/2018 Stroyer ..... E04B 2/7453

* cited by examiner

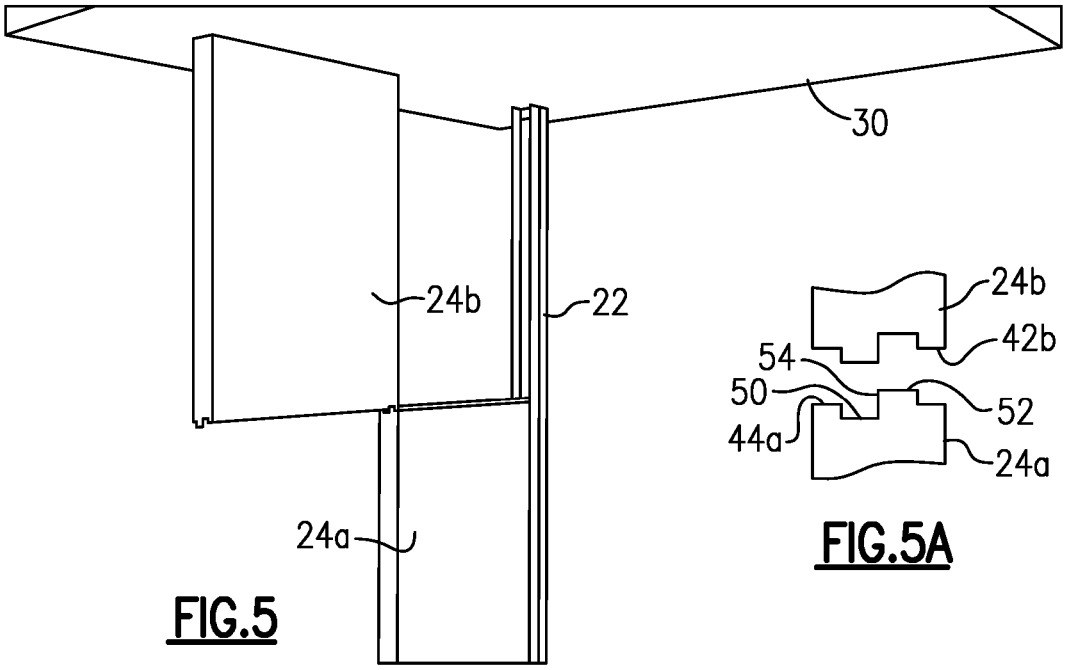
FIG.5
FIG.5A
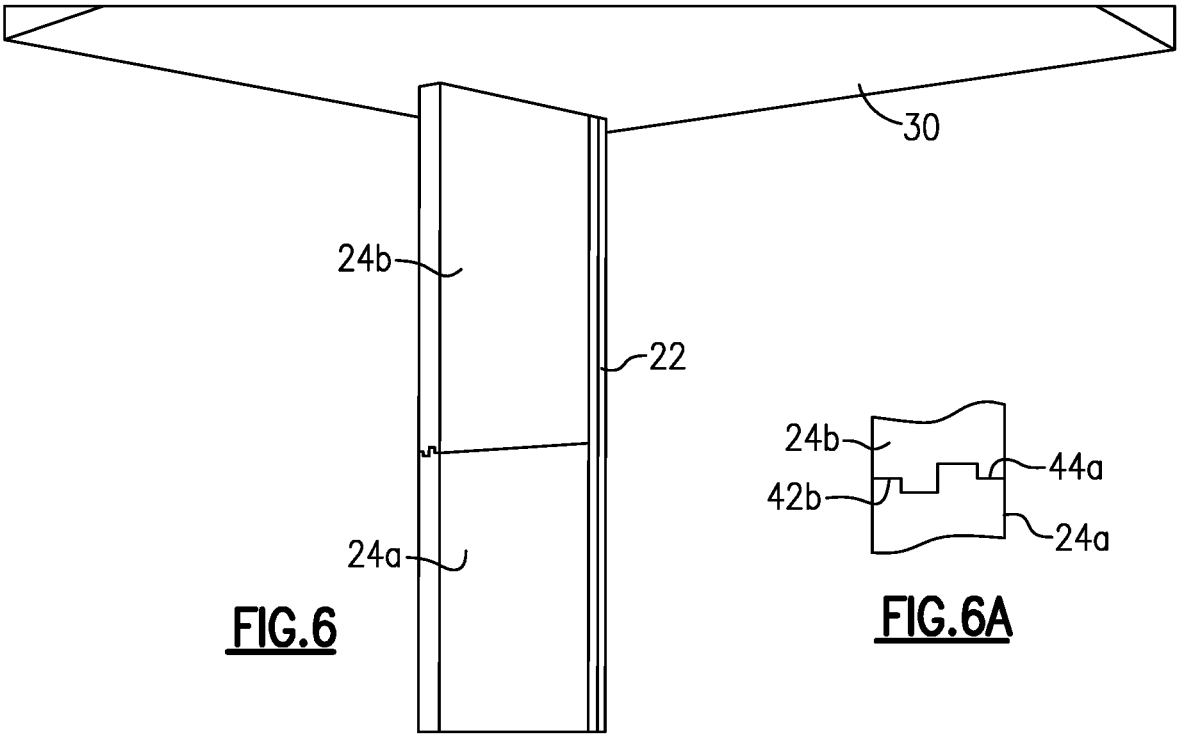
FIG.6
FIG.6A

WEATHER RESISTANT TEMPORARY WALL SYSTEM AND METHOD

BACKGROUND OF THE INVENTION

This invention relates to a temporary wall system which provides a protective barrier against inclement weather and is particularly useful in the building construction field.

Building construction and building renovations may expose the interior of the building under construction or renovation to the outside due to the lack of a complete perimeter wall. For example, the façade of many buildings are frequently renovated to maintain their so-called "curb-side appeal". During renovation, the exterior walls are sometimes removed thereby exposing the interior space to the outside. Should there be inclement weather while the exterior walls are removed, the interior space is at risk of damage due to the entry of wind, rain and/or snow, for example. There therefore exists a need for a temporary, weather resistant wall structure which can be easily and quickly erected at a location outwardly of but adjacent the existing exterior wall structure which is about to undergo renovation, and likewise easy and quick to disassemble once renovations are complete.

SUMMARY OF THE INVENTION

The present invention addresses the above needs by providing a weather resistant temporary wall structure system which is easy and quick to both assemble and disassemble. The system includes modular wall panels which include profiles along their side edges to permit them to removably attach to support posts which themselves are secured in place from floor to ceiling. The panels further include edge profiles along their respective top and bottom edges which permit one panel to slidingly attach to an adjacent panel located above or below the first panel. The top and bottom edge profiles may be formed with geometries that will impede the entry of rain therebetween.

The panels may be formed of expanded polystyrene (EPS) or other material. The wall panels may further include a reinforcement structure integrated into each panel such as a furring channel, for example. The reinforcement could either be integrated into the panels when the panels are made or could be attached thereafter. A reinforcement structure such as a furring channel, for example, could easily slide into a complimentary shaped channel cut or otherwise formed in the panel, for example. The furring channel or other reinforcement structure can extend perpendicularly relative to the floor-ceiling support posts, or it may extend at other angles if desired. The wall panels may optionally be structurally reinforced with a string reinforced polyethylene applied to one or both of the opposite planar surfaces of the panel.

BRIEF DESCRIPTION OF THE DRAWINGS

The invention will further be described, by way of example, with reference to the accompanying drawings:

FIG. 5 is a perspective view of a second modular wall panel being coupled to the first modular wall panel and the support post;

FIG. 5A is a fragmented, enlarged plan view of the adjoining wall panels top and bottom edges in spaced relation to each other;

FIG. 6 is a perspective view of the second modular wall panel of FIG. 5 coupled to the first modular wall panel and the support post;

FIG. 6A is the view of FIG. 5A showing the top and bottom edges in abutting relation to each other;

Similar reference characters refer to similar parts throughout the several views of the drawings.

DETAILED DESCRIPTION

Figure 1:
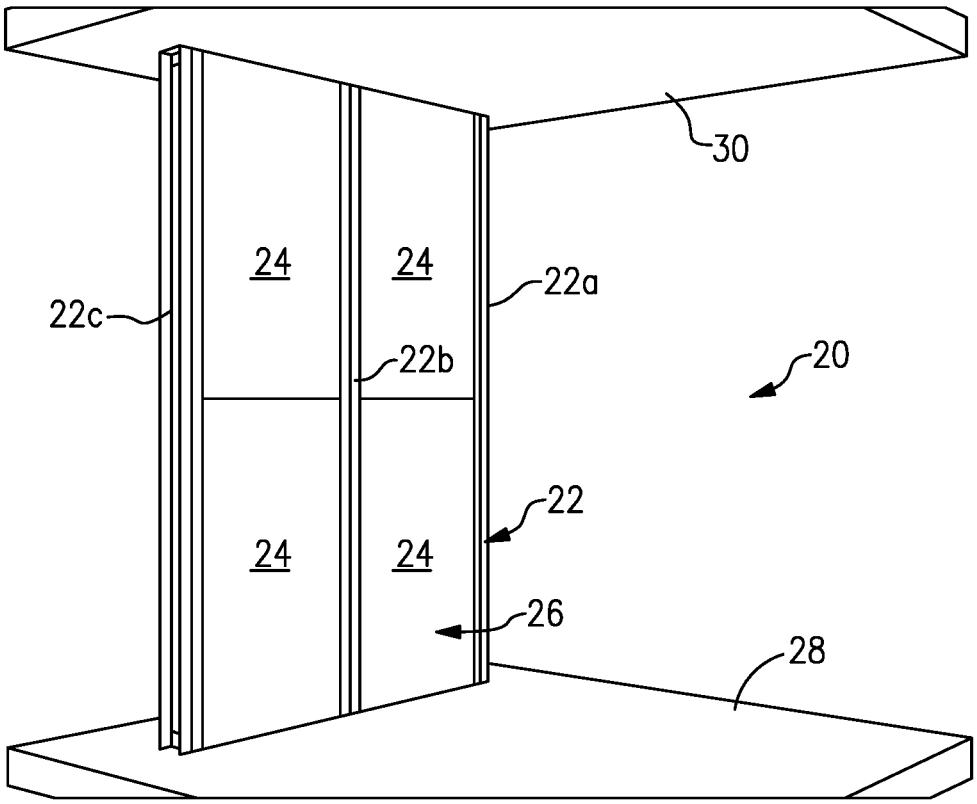
FIG. 1 is a perspective view of a temporary wall system in accordance with an embodiment of the present invention.
Figure 2:
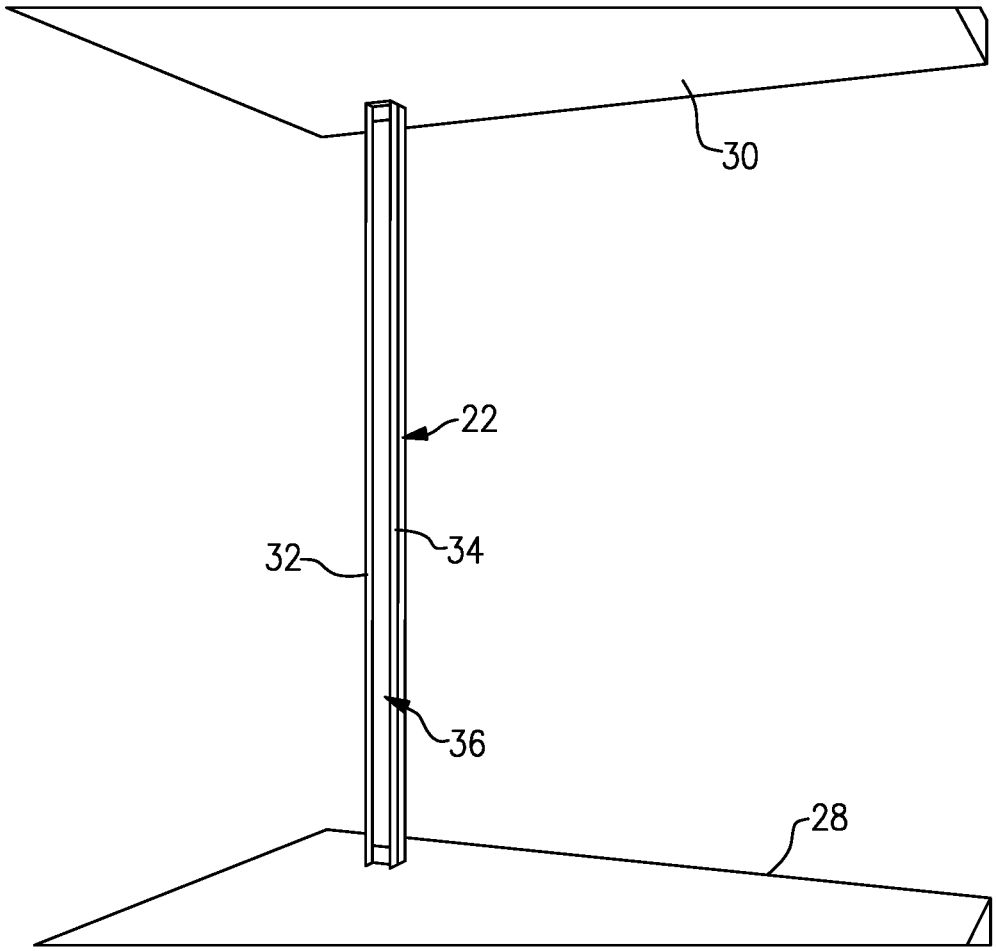
FIG. 2 is a perspective view of a support post used within the temporary wall system shown in FIG. 1.
Figure 3:
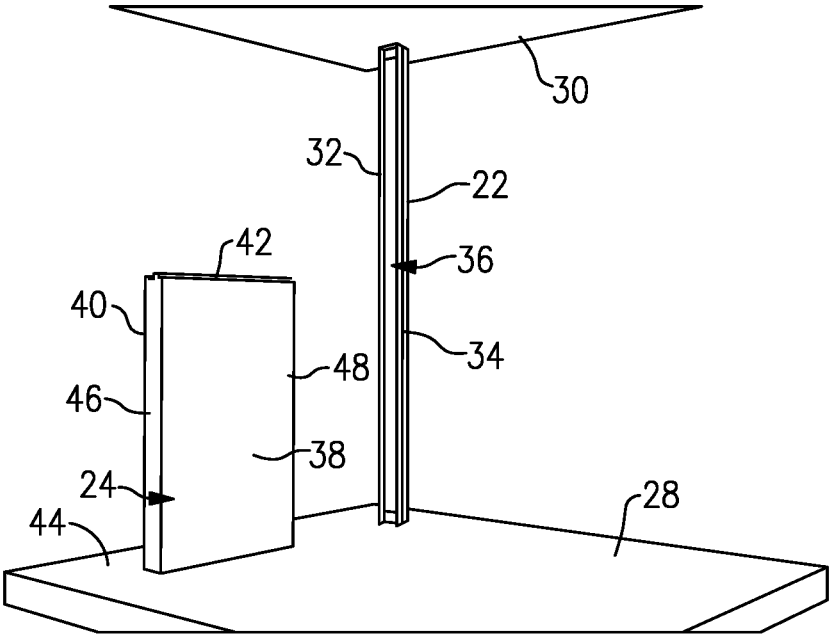
FIG. 3 is a perspective view of a first modular wall panel being coupled to the support post shown in FIG. 2.
Figure 4:
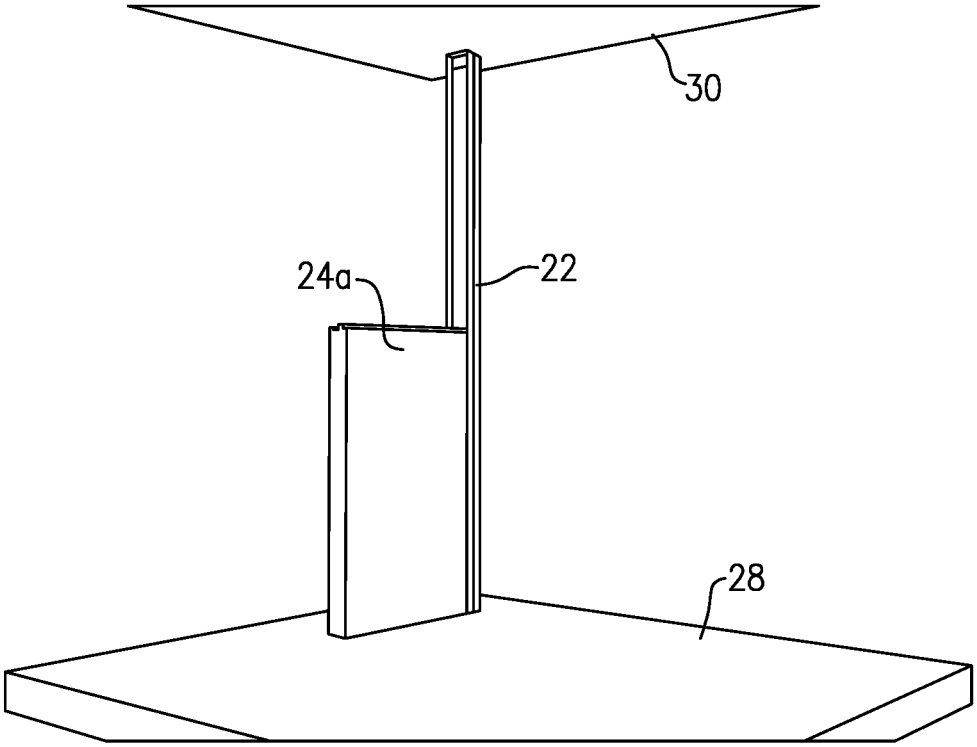
FIG. 4 is a perspective view of the first modular wall panel of FIG. 3 coupled to the support post.
Figure 7:
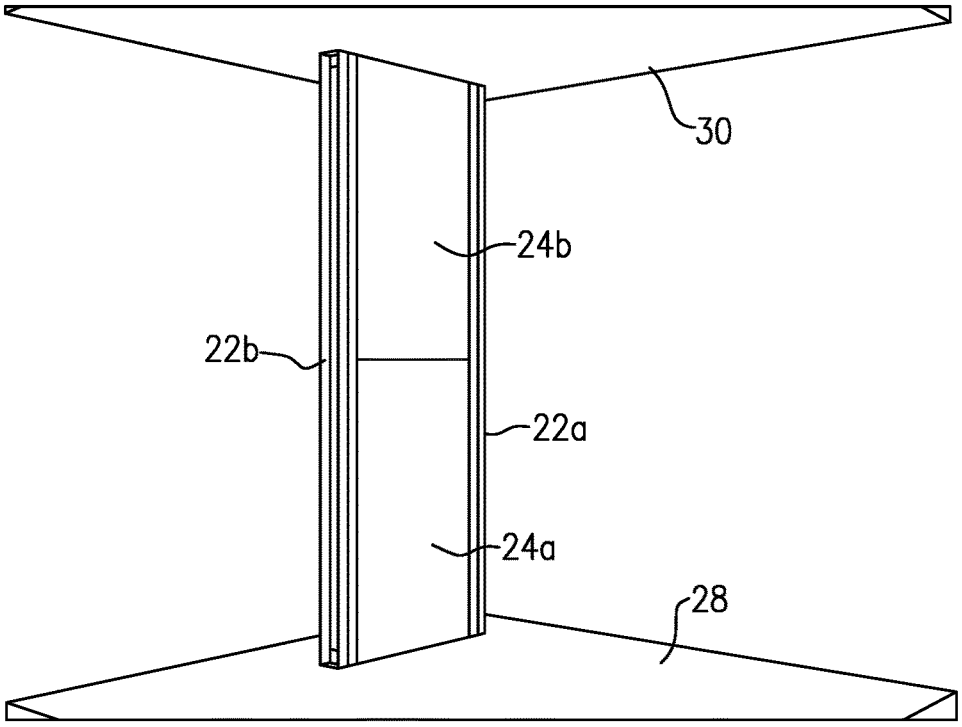
FIG. 7 is a perspective view of a second support post coupled to the first and second modular wall panels.
Figure 8:
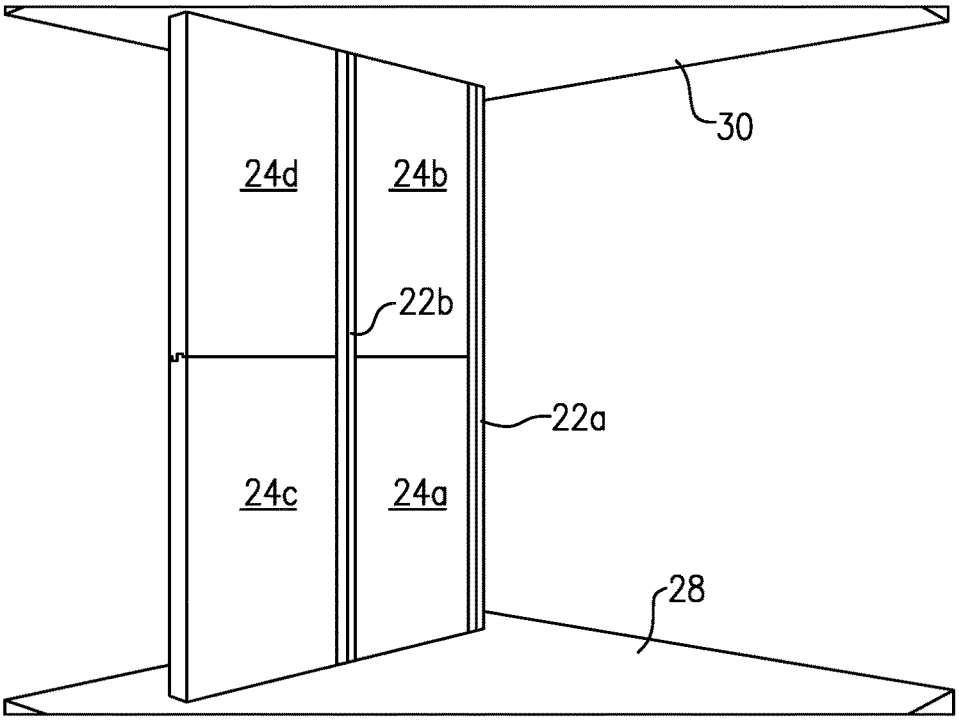
FIG. 8 is a perspective view of third and fourth modular wall panels coupled to the second support post.

Referring now to FIGS. 1-8, a weather resistant temporary wall structure system 20 generally includes a plurality of support posts 22 and modular wall panels 24 arranged to form a temporary wall structure 26. Each support post 22 may be adapted to removably attach and extend between a floor 28 and ceiling 30. Each support post 22 may include first and second opposite side edges 32, 34, each having a predetermined edge profile. Each modular wall panel 24 may include opposite outside and inside planar surfaces 38, 40 and top and bottom edges 42, 44 each having a predetermined profile, and opposite first and second side edges 46, 48 each having a predetermined edge profile. The profile of each of the wall panel first and second side edges 46, 48 may be formed complimentary to the profile of each of the support post first and second side edges 32, 34 such that wall panels 24 may be removably attached to and between the support posts.

By way of example and by no means limiting solely thereto, each support post 22 may include a generally U-shaped cross section profile thereby having the first side edge 32 include an edge profile defining a groove 36 and second side edge 34 having a planar edge profile. Alternatively, a support post 22 may include an I-shaped cross section profile having each first and second side edge 32, 34 defining opposing groove edge profiles.

In a further aspect of the present invention, the profile of each of the wall panel top and bottom edges 42, 44 may be complimentarily shaped such that the top edge 44*a* of a first wall panel 24*a* may be removably attached to the bottom edge 42*b* of a second wall panel 24*b* and when joined together, the top and bottom edges create a physical barrier to the passage of water therethrough and wall panels 24*a*, 24*b* extend substantially from floor 28 to ceiling 30.

In accordance with another aspect of the present invention, the profile of each of wall panel top edge 44 may include first and second segments 50, 52 which traverse the length of a respective wall panel in adjacent, parallel relationship to each other with first segment 50 extending adjacent to the wall panel outside planar surface 38 and the second segment 52 extending adjacent to the wall panel inside planar surface 40. The first and second segments 50, 52 may be offset from each other to form a step 54 with the second segment 52 raised relative to the first segment 50 so as to create the physical barrier (see FIGS. 5, 5A, and 6, 6A).

In accordance with another aspect of the present invention, each of first and second wall panels 24*a*, 24*b* may include a panel height H which is one-half the length L of support post 22. In this manner, second wall panel 24*b* may be rotated 180 degrees and flipped edge-over-edge. In such an instance, opposite outside and inside planar surfaces 38*b*, 40*b*, top and bottom edges 42*b*, 44*b*, and opposite first and second side edges 46*b*, 48*b* of side wall panel 24*b* may be redefined accordingly. Second wall panel 24*b* may then be joined together with first wall panel 24*a* as described above.

FIGS. 2 through 7 illustrate a stepwise method of construction of temporary wall structure 26. As shown most clearly in FIG. 2, a first support post 22*a* may be removably secured to floor 28 and ceiling 30 via respective connectors 50*a*, 50*b*. A shown in FIGS. 3 and 4, first modular wall panel 24*a* may then be received within channel 36. Second modular wall panel 24*b* may then be coupled to first modular wall panel 24*a* as described above. A second support post 22*b* may then couple with wall panels 24*a*, 24*b* (such as through a respective groove, not shown) so as to constrain wall panels 24*a*, 24*b* between support posts 22*a*, 22*b* and prevent lateral displacement of the wall panels. Additional support posts 22*c* and modular wall panels 24*c*, 24*d* may be serially added so as to create continuous temporary wall structure 26.

Figure 9:
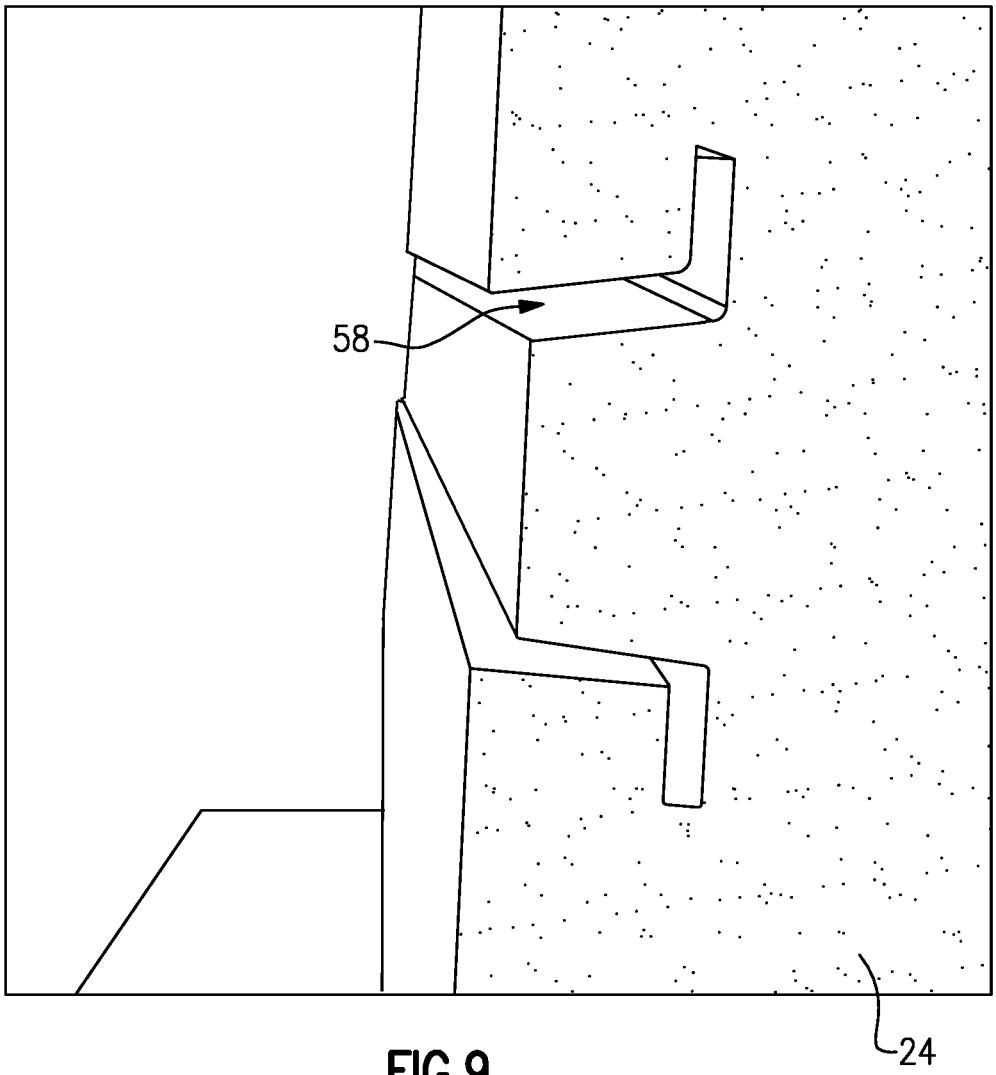
FIG. 9 is a side perspective view of a panel channel in accordance with an embodiment of the present invention.
Figure 10:
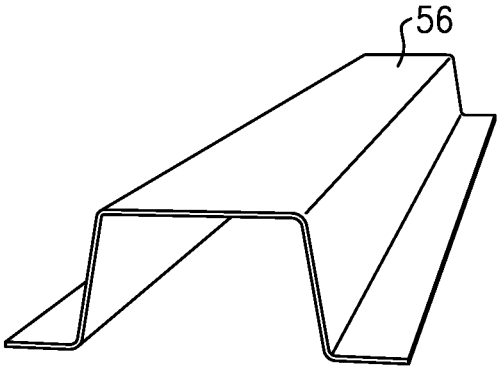
FIG. 10 is a perspective view of a furring channel in accordance with an embodiment of the present invention.
Figure 11:
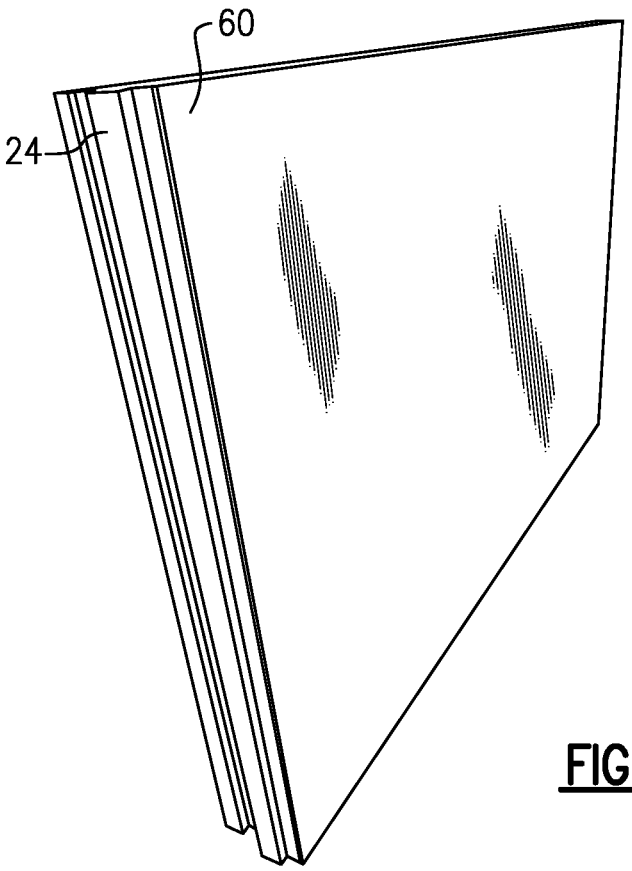
FIG. 11 is a modular wall panel including a reinforcing material in accordance with an embodiment of the present invention.

In accordance with one aspect of the present invention, one or more wall panels 24 may further include a reinforcement member attached to each wall panel. By way of example and by no means limiting solely thereto, as shown in FIGS. 9 and 10, the reinforcement member may a furring channel 56. In a further aspect of the present invention, wall panel 24 may include a panel channel 58 which complimentarily shaped to furring channel 56 so as to permit furring channel 56 to be slidingly and removably attached into panel channel 58 of wall panel 24. Additionally or alternatively, as shown in FIG. 11, the reinforcement member may include a reinforcement material 60 attached to one or both of the inside and outside planar surfaces 38, 40 of each wall panel 24. In accordance with an aspect of the present invention, wall panels 24 may be formed from expanded polystyrene and the reinforcement material may comprise string reinforced polyethylene.

Although the invention has been described with reference to preferred embodiments thereof, it is understood that various modifications may be made thereto without departing from the full spirit and scope of the invention as defined by the claims which follow. While specific reference has been made to rotational movements of device components, it should be understood by those skilled in the art that such rotations may be reversed and that such teachings are within the scope of the present invention.

What is claimed is:

1. A weather resistant temporary wall system, comprising:

a) a plurality of wall panels each having an outside planar surface and an inside planar surface and top and bottom edges each having a predetermined edge profile and opposite first and second side edges each having a predetermined side edge profile;

b) a plurality of support posts adapted to removably attach and extend between a floor and a ceiling, said support posts each having first and second opposite post side edges each having a predetermined post side edge profile;

wherein said side edge profile of each of said wall panel first and second side edges is formed complimentary to said post side edge profile of each of said support post first and second post side edges such that said wall panels are configured to be removably attached to and between said support posts;

wherein said profile of each of said wall panel top and bottom edges are complimentary shaped to one another such that the top edge of a first wall panel is configured to be removably attached to the bottom edge of a second wall panel, and when joined together the top and bottom edges creating a physical barrier to the passage of water therethrough; and wherein said profile of each of said wall panel top edges include first and second segments which traverse a length of a respective panel in adjacent, parallel relationship to each other with said first segment extending adjacent to the wall panel outside planar surface and the second segment extending adjacent to the wall panel inside planar surface and wherein said first and second segments are offset from each other to form a step with the second segment raised relative to the first segment, and wherein said wall panel bottom edges include first and second segments which traverse the length of a respective panel in adjacent, parallel relationship to each other with said first segment extending adjacent to the wall panel outside planar surface and the second segment extending adjacent to the wall panel inside planar surface and wherein said first and second segments are offset from each other to form a step with the second segment raised relative to the first segment.

2. The weather resistant temporary wall system of claim 1 and further comprising a reinforcement member attached to each wall panel of said plurality of wall panels.

3. The weather resistant temporary wall system of claim 2 wherein said reinforcement member is a furring channel.

4. The weather resistant temporary wall system of claim 3 wherein each of said plurality of wall panels includes a channel complimentary shaped to said furring channel to permit said furring channel to be slidingly and removably attached into the channel of a respective wall panel.

5. The weather resistant temporary wall system of claim 1 and further comprising a reinforcement material attached to one or both of said inside planar surface and said outside surface of each wall panel of said plurality of wall panels.

6. The weather resistant temporary wall system of claim 5 wherein said reinforcement material comprises string reinforced polyethylene.

7. The weather resistant temporary wall system of claim 1 wherein said wall panels are formed from expanded polystyrene.

8. The weather resistant temporary wall system of claim 7 and further comprising a reinforcement material attached to one or both of said inside and outside surfaces of each wall panel of said plurality of wall panels.

9. The weather resistant temporary wall system of claim 8 wherein said reinforcement material comprises string reinforced polyethylene.

10. A method of forming a weather resistant temporary wall system, comprising the steps of:

a) providing a plurality of wall panels each having an outside planar surface and an inside planar surface and top and bottom edges each having a predetermined edge profile and opposite first and second side edges each having a predetermined side edge profile wherein said profile of each of said wall panel top and bottom edges are complimentary shaped such that the top edge of a first wall panel is configured to be removably attached to the bottom edge of a second wall panel when joined together and wherein said profile of each of said wall panel top edges include first and second segments which traverse a length of a respective panel in adjacent, parallel relationship to each other with said first segment extending adjacent to the wall panel outside planar surface and the second segment extending adjacent to the wall panel inside planar surface and wherein said first and second segments are offset from each other to form a step with the second segment raised relative to the first segment, and wherein said wall panel bottom edges include first and second segments which traverse the length of a respective panel in adjacent, parallel relationship to each other with said first segment extending adjacent to the wall panel outside planar surface and the second segment extending adjacent to the wall panel inside planar surface and wherein said first and second segments are offset from each other to form a step with the second segment raised relative to the first segment, thereby creating a physical barrier to the passage of water therethrough;

b) providing at least first and second support posts and removably attaching said first and second support posts in spaced, parallel relation to each other to and between a floor and a ceiling, said first and second support posts each having first and second opposite post side edges each having a predetermined post side edge profile formed complimentary to said side edge profile of each of said wall panel first and second side edges such that said wall panels are configured to be removably attached to and between said first and second support posts; and c) removably attaching the first and second wall panels to and between said first and second support posts with the top edge of said first wall panel being attached to the bottom edge of said second wall panel.

* * * * *